United States Patent [19]

Lineberry et al.

[11] Patent Number: 4,646,598

[45] Date of Patent: Mar. 3, 1987

[54] BRICK CUTTING AND HANDLING APPARATUS HAVING MOVABLE WIRE BANK CUTTER ASSEMBLY

[76] Inventors: Cletus E. Lineberry, Rte. 1, Box 106, Staley, N.C. 27355; John G. Buckner, Rte. 2, Box 83, Ramseur, N.C. 27316; Jimmy W. Harris, 618 Circle Dr., Siler City, N.C. 27344

[21] Appl. No.: 663,407

[22] Filed: Oct. 22, 1984

[51] Int. Cl.[4] ..... B26D 1/553

[52] U.S. Cl. ..... 83/56; 83/651.1; 83/427; 83/23; 83/168

[58] Field of Search ..... 83/56, 23, 651.1, 401, 83/599, 644, 425.2, 168, 427, 437, 578, 49

[56] References Cited

U.S. PATENT DOCUMENTS

| | | | |
|---|---|---|---|
| 3,838,621 | 10/1974 | Keck | 83/651.1 X |
| 4,173,911 | 11/1979 | Lineberry et al. | 83/651.1 X |
| 4,328,724 | 5/1982 | Lingl | 83/651.1 X |

*Primary Examiner*—Donald R. Schran
*Attorney, Agent, or Firm*—Mills and Coats

[57] ABSTRACT

The present invention relates to a brick cutting and handling apparatus having a movable wire bank cutter assembly. The wire bank cutter assembly is movably confined within a holding frame structure and is movable generally vertically up and down therein in a rectilinear fashion. As a respective brick slug is pushed through the wire bank cutter assembly, the wire bank cutter assembly is moved generally downwardly. This vertical downward movement tends to form a swirl-like configuration on opposite sides of the individual cut brick. Further, roots, sprigs and other such debris are often caught on the respective wires of the wire bank cutter assembly as respective brick slugs are pushed therethrough. This vertical up and down movement of the wire bank cutter assembly tends to pull such roots, sprigs, etc., from the respective slugs and once pulled from the slug or slugs, these same roots, sprigs, etc., are stripped therefrom.

17 Claims, 8 Drawing Figures

BRICK CUTTING AND HANDLING APPARATUS HAVING MOVABLE WIRE BANK CUTTER ASSEMBLY

FIELD OF INVENTION

The present invention relates to methods and apparatuses for cutting and handling brick, and more particularly to a method and apparatus for cutting and handling brick including a wire bank brick slug cutter assembly.

BACKGROUND OF INVENTION

Clay or clay type soils form the basic structural material of brick. Typically such soil is transferred to a brick producing facility where it is appropriately mixed to form a brick material which through an extraction process produces elongated brick slugs. These elongated brick slugs are then pushed through a wire bank cutter assembly where the brick slugs are cut into individual bricks after which the bricks are cured.

Roots, sprigs and other such debris which are found in the original soil are not always filtered out by the screening ordinarily used in the brick producing process. Such roots, sprigs, etc., find themselves in the brick slugs being pushed through the wire bank cutter assembly. As the brick slugs are pushed through, these roots, sprigs and other such debris are caught on the respective wires forming the wire bank cutter assembly. The presence of such roots and sprig material on the wires tends to gouge and scrape the flat large area side of the cut brick as they are pushed through the wire bank cutter assembly.

In addition, over a period of time there can be a substantial build-up of such root and sprig material that results in the brick producing process having to be halted in order to clean the roots and sprigs and other such types of material from the wire bank cutter assembly.

Therefore, there is a need to provide means within a brick cutting and handling apparatus for removing roots, sprigs, etc., from the wire bank cutter assembly without requiring the brick cutting operation to be entirely halted.

SUMMARY AND OBJECTS OF INVENTION

The present invention presents a brick cutting and handling system that is designed to automatically remove roots, sprigs and other such material from the wire bank cutter assembly during the actual brick cutting process. In particular, the method and apparatus of the present invention entails movably mounting the wire bank cutter assembly such that the same moves generally upwardly and downwardly through an underlying support surface. The wire bank cutter assembly is designed to move in time relationship with a brick slug pusher. Thus as a respective brick slug is being pushed through the wire bank cutter assembly, the wire bank cutter assembly will be actuated and driven downwardly in a generally rectilinear fashion. As the wire bank cutter moves downwardly through openings within an underlying support surface, any roots, sprigs, etc., entangled about the wires of the wire bank cutter tend to be carried and pulled downwardly from the brick material. Once the wire bank cutter assembly reaches its extreme downward position, the same is actuated to move back upwardly and in the process, the roots, sprigs, etc., tend to be stripped by the overlying slug or slugs from the respective wires of the wire bank cutter assembly. Thus, it is appreciated that the vertical up-and-down movement of the wire bank cutter assembly pulls roots, sprigs, etc., from the brick material and tends to strip and clean the wires of the wire bank cutter assembly during the brick cutting process.

In addition, it is found that the simultaneous movement of the respective wires of the wire bank cutter assembly with the movement of the brick slug passing therethrough imparts a somewhat swirl configuration to the flat large area size of the individual bricks. This swirl type configuration is especially attractive and desirable in a paver type brick.

It is therefore, an object of the present invention to provide a brick cutting method and apparatus that has the capability of automatically removing roots, sprigs, etc., from a wire bank cutter assembly without the need for stopping the brick cutting process in any way.

A further object of the present invention is to provide a brick handling apparatus including means for automatically stripping roots, sprigs and other such debris from the respective wires of the wire bank cutter assembly during the actual brick cutting operation.

Still a further object of the present invention resides in the provision of a brick cutting and handling apparatus wherein the wire bank cutter assembly is movably mounted for generally vertical rectilinear movement with respect to a passing brick slug such that during the brick cutting operation the movement of the wire bank cutter assembly with respect to the passing brick slug tends to pull roots, etc., from the slug and strip such root and sprig material from the respective wires of the wire bank cutter.

A further object of the present invention resides in the provision of a method and apparatus for cutting and handling brick which forms a swirl-like configuration along the flat large area sides of the bricks so as to make the bricks particularly appealing and desirable for use as brick pavers.

Another object of the present invention resides in the provision of a brick handling and brick cutting apparatus that is capable of providing such swirl-like pattern through the provision of a vertically movable wire bank cutter which is designed to be actuated for generally vertical movement while the respective brick slugs are being pushed therethrough.

Still a further object of the present invention resides in the provision of a method and apparatus for cutting and handling brick wherein the wire bank cutter assembly is also designed such that the same can be moved back and forth such that the entire wire bank cutter assembly may be moved through a stationary slug.

Other objects and advantages of the present invention will become apparent from a study of the following description and the accompanying drawings which are merely illustrative of such invention.

METHOD AND APPARATUS FOR CUTTING AND HANDLING BRICK

With further reference to the drawings, the brick handling and cutting apparatus of the present invention is shown therein and indicated generally by the numeral 10. First, it should be particularly pointed out that the present invention deals with that portion of a total brick handling system wherein individual brick slugs are cut to form a series of individual bricks. In that same regard, the brick cutting and handling system described herein is of the type that utilizes a wire bank cutter assembly for cutting the respective brick slugs into a plurality of bricks. Therefore, the present disclosure will deal with that area of a total brick handling system that acts to cut the respective brick slugs being transferred through the brick handling system.

Figure 1:
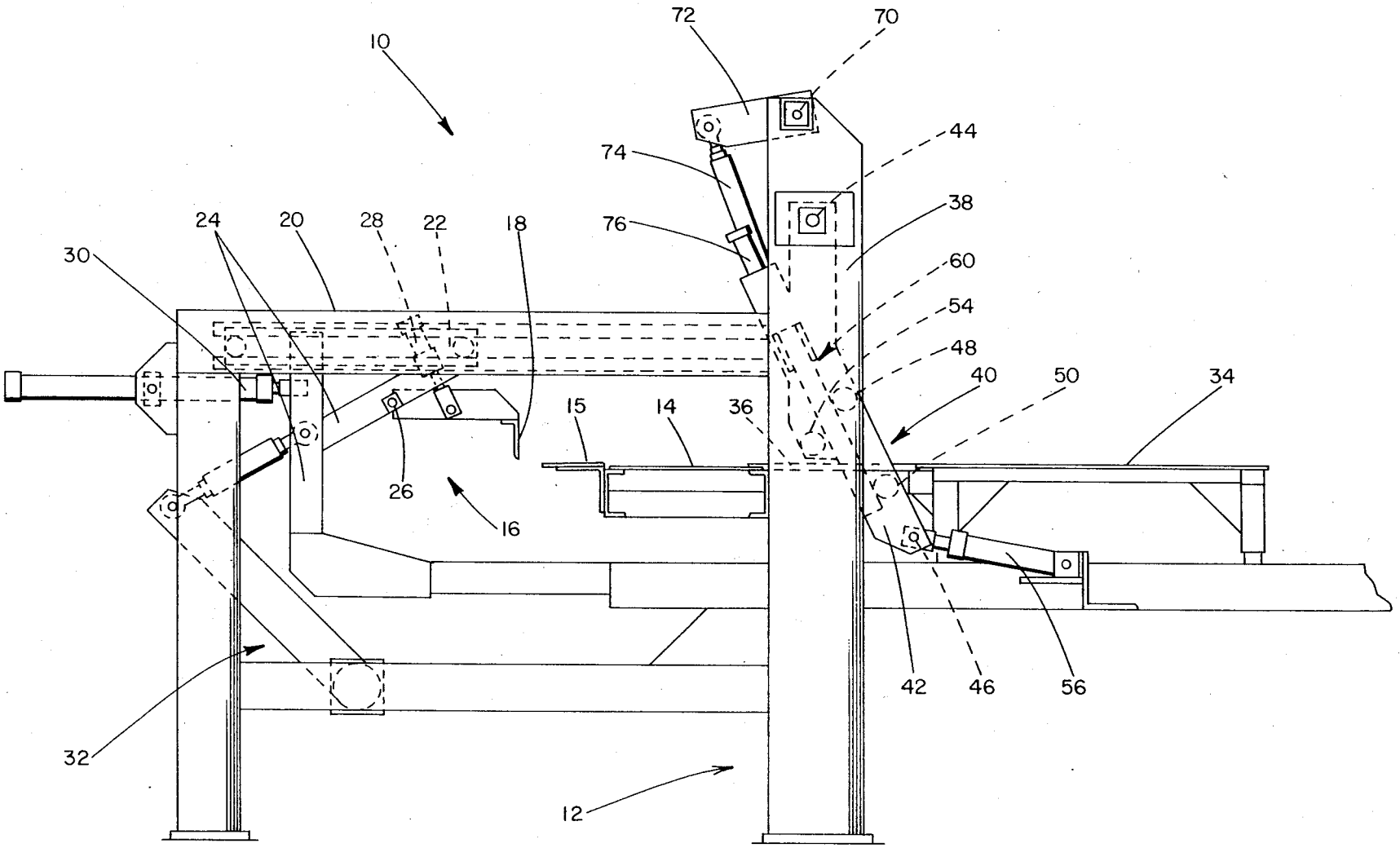
FIG. 1 is a side elevational view of a brick handling system including the movable wire bank cutter assembly of the present invention.

With particular reference to FIG. 1, there is shown therein the brick cutting and handling apparatus of the present invention and the same is indicated generally by the numeral 10. Brick handling apparatus 10 comprises a main frame structure indicated generally by the numeral 12.

Secured to main frame structure 12 is an off-bearing belt 14. The function of offo-bearing belt 14 is to deliver successive brick slugs to a discharge point. As will be more fully appreciated from subsequent portions of this disclosure, at the discharge point on the off-bearing belt 14, the respective slugs are pushed from the off-bearing belt through a wire bank cutter assembly which acts to cut the respective brick slugs into a series of individual bricks.

Mounted adjacent off-bearing belt 14 is a brick slug pusher means indicated generally by the numeral 16. Brick slug pusher means acts to engage respective brick slugs on off-bearing belt 14 or shelf 15 associated therewith and to push the respective brick slugs through a wire bank cutter assembly disposed on the opposite side of the off-bearing belt 14. Details of the brick slug pusher means 16 will not be dealt with herein in detail because such is presently commercially available in the brick producing industry and is well known in the art. For a complete and unified understanding of a typical brick slug pusher assembly, one is referred to the disclosures found in U.S. Pat. Nos. 4,173,910; 4,211,130; and 4,173,911, these disclosures being expressly incorporated herein by reference.

But briefly it is seen from FIG. 1 that brick slug pusher means 16 includes a pusher 18 that is secured to a rock shaft 26 which is carried by a pusher frame structure 24. The pusher frame structure 24 is secured to a carriage 22 that is movably confined within an upper frame structure 20 of the main frame structure 12. A torque arm and guide linkage assembly, indicated generally by the numeral 32, is operatively interconnected between main frame structure 12 and pusher frame structure 24. To actuate pusher 18 back and forth over off-bearing belt 14, there is provided hydraulic drive cylinder means 30 which is anchored to the main frame structure 12 and which is connected to pusher frame structure 24. To pivot pusher 18 about the transverse axis of rock shaft 26, there is provided a second hydraulic cylinder means 28. This enables pusher 18 to be raised in order to clear a brick slug that may be disposed on off-bearing belt 14 as the pusher is moved from right to left as viewed in FIG. 1 during the brick cutting operation.

Disposed on the right side of off-bearing belt 14, again as viewed in FIG. 1, is a receiving table 34. Interposed between receiving table 34 and off-bearing belt 14 is a brick support surface 36 that includes a series of openings formed therein. From subsequent portions of this disclosure, the significance of these openings will be understood and fully appreciated inasmuch as they allow respective wires of the wire bank cutter assembly to pass therethrough.

Figure 3:
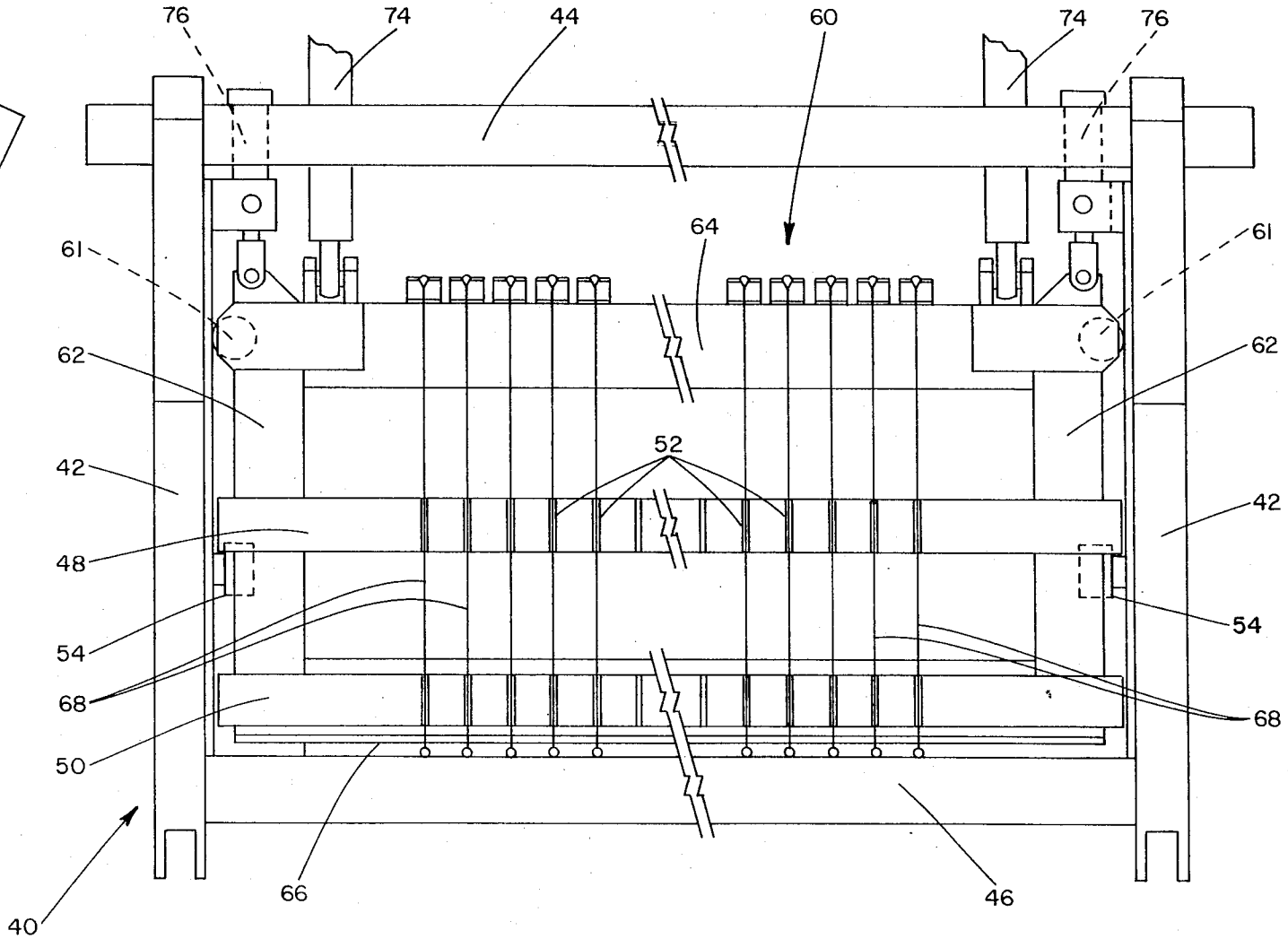
FIG. 3 is a front elevational view showing the movable wire bank cutter assembly and its holding structure.
Figure 2:
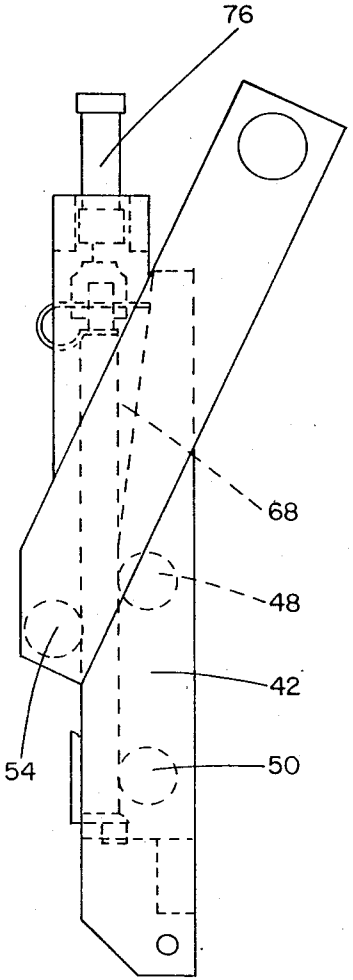
FIG. 2 is a side elevational view of the movable wire bank cutter assembly and its holding structure of the present invention.
Figure 4:
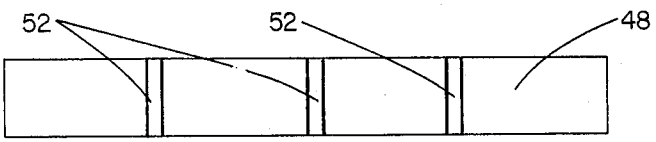
FIG. 4 is a view illustrating one of the notched rollers associated with the holding frame structure that holds and confines the movable wire bank cutter assembly.
Figure 5:
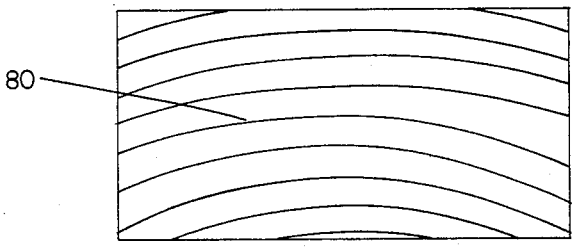
FIGS. 5 through 8 are a series of illustrations showing various type designs that can be achieved by selectively moving the wire bank cutter assembly of the present invention as a brick slug is passed therethrough.

Main frame structure 12 includes a pair of laterally spaced upright frame members 38 that extend generally between off-bearing belt 14 and receiving table 34. Secured to upright frame members 38 is a holding frame structure indicated generally by the numeral 40 (see FIGS. 2 and 3). Holding frame structure includes a pair of side frames 42 that assume a generally dog-leg shape. A transverse shaft 44 is secured between upright frame members 38 and is also secured to upper end portions of the respective side frames 42. Side frames 42 may rotate about the transverse axis of transverse shaft 44. In addition holding frame structure 40 includes a lower transverse member 46.

A pair of rollers 48 and 50 are rotatively mounted about one side of holding frame structure 40. Each roller 48 and 50 includes a series of generally V-shaped notches 52 formed therein.

Disposed about the opposite side of holding frame structure 40 is a pair of laterally spaced guide rollers 54.

In order to move holding frame structure 40 back and forth about the axis of transverse shaft 44, there is provided hydraulic cylinder means 56 that is operatively connected to the lower end of holding frame structure 40.

Holding frame structure 40 is designed and adapted to receive and hold a wire bank cutter assembly indicated generally by the numeral 60. Wire bank cutter assembly 60 is of a generally conventional design inasmuch as the same includes a frame structure having a series of laterally spaced wires 68 extending in a transverse plane. More particularly, wire bank cutter assembly 60 includes a pair of side frames 62 and an upper transverse frame member 64 extending between side frame 62 as well as a lower transverse frame member 66 which likewise extends between side frames 62.

Wire bank cutter assembly 60 is suspended about the brick cutting and handling apparatus 10 by a connecting linkage that includes a transverse shaft 70 secured transversely between upright frame members 38. Secured to shaft 70 is a pair of laterally spaced arms 72 that connect to a pair of connecting links 54 which are in turn connected to wire bank cutter assembly 60 and particularly the upper transverse frame member 64 thereof. In addition a pair of hydraulic cylinders 76 are operatively interconnected between the main frame structure 12 of the brick cutting and handling apparatus and wire bank cutter assembly 60. As will be appreciated from subsequent portions of this disclosure, the function of the hydraulic cylinders 76 is to actuate and drive wire bank cutter assembly 60 generally upwardly and downwardly during the brick cutting operation.

It is seen that there is defined within holding frame structure 40 an area for receiving and holding wire bank cutter assembly 60. This defined area lies between the forward rollers 48 and 50 and the rear cam type rollers 54. In fact rollers 48 and 50 in cooperation with cam rollers 54 actually confine and hold wire bank cutter assembly 60 within holding frame structure 40. It is appreciated, however, that wire bank cutter assembly 60 may move up and down within holding frame structure 40. Front rollers 48 and 50 actually roll adjacent one side of the side frames 62 while the rear cam type rollers 54 engage and roll adjacent the back side of side frames 62. Moreover, front rollers 48 and 50 are positioned with respect to the respective wires 68 of the wire bank cutter assembly 60 such that the respective wires extend through the particularly spaced V-shaped notches 52 formed in each of the rollers 48 and 50. Also it is noted that there is a cam type roller 61 formed about the upper outer edge of each side frame 62. This cam type roller 61 engages the dog-leg shaped side frames 42 of holding frame structure 40 and facilitates the up-and-down movement of the wire bank cutter assembly 60 within the holding frame structure 40.

It is further noted that in the assembled position as shown in FIG. 1 that the respective wires 68 of the wire bank cutter assembly 60 extend through the elongated openings formed in the brick support surface 36. Consequently the entire wire bank cutter assembly 60 may move upwardly and downwardly therethrough without encountering interference.

Hydraulic cylinders 76 are typically timed to be actuated in accordance with the actuation of brick slug pusher means 16. That is, as a brick slug or brick slugs are being pushed across brick support surface 36 and through the wire bank cutter assembly 60, the hydraulic cylinders 76 are actuated to push wire bank cutter assembly 60 downwardly within holding frame structure 40. As the brick slug pusher means is returned or forming some other operation besides actually pushing a brick slug or brick slugs through the wire bank cutter assembly 60, then hydraulic cylinders 76 are operative to pull the wire bank cutter assembly 60 from its downwardmost position to its uppermost position.

As alluded to hereinbefore, it is not uncommon for roots, sprigs and other such debris found in the brick material to become caught and entangled about the respective wires 68 as brick slugs are pushed therethrough. The downward and slightly forward movement of the wire bank cutter assembly 60 tends to carry the roots, sprigs, etc., with the respective wires 68. As the wire bank cutter assembly 60 and the wires 68 thereof move downwardly, the roots, sprigs, etc., are pulled from the passing brick slug or slugs. Then when the wire bank cutter assembly 60 begins to move back upwardly the overlying brick slug tends to strip such roots, sprigs, etc., from the wires 68. Thus the cycling of the wire bank cutter 60 tends to pull roots, sprigs, etc., from the passing brick slugs and once pulled from the brick slugs the overlying brick slug itself strips and cleans the roots and sprigs from wires 68 as they are pulled back upwardly between respective cut portions of the overlying slug.

In addition the actual movement of the wires 68 while a brick slug is being pushed therethrough gives rise to a swirl-type configuration formed about the flat large area side of the bricks being cut. It is the engagement of the generally vertically moving wires with the brick slug as the same is being pushed therethrough that gives rise and causes such a swirl-type configuration which is especially desirable from a design point of view for brick pavers.

Figure 6:
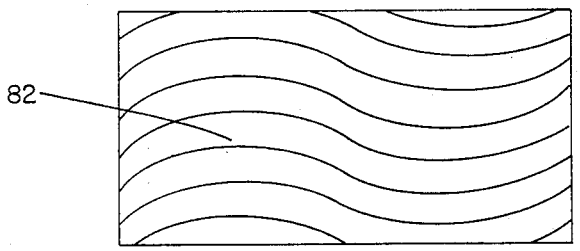
Figure 7:
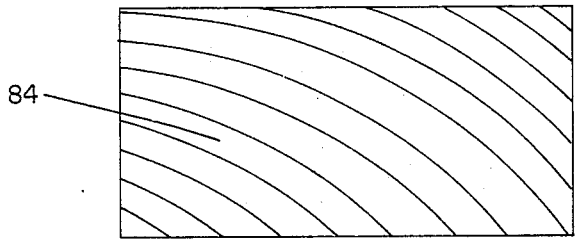
Figure 8:
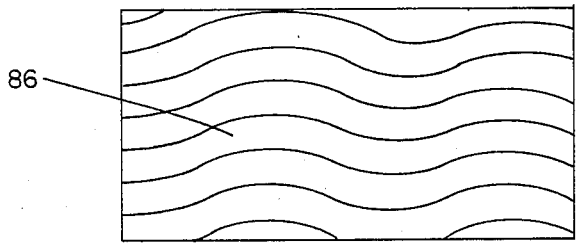

As illustrated in FIGS. 5 through 8, various swirl-type designs can be achieved by varying the movement of the wire bank cutter assembly 60 as a brick slug is pushed or passed therethrough. For example, in FIG. 5, a design such as shown therein is achieved by first moving the wire bank cutter assembly 60 upwardly and then back down while the slug is being pushed therethrough. In FIG. 6, the design shown therein can be achieved by moving the wire bank cutter assembly 60 up, down and then back up while the slug is passed therethrough. In FIG. 7, the design shown therein is achieved by moving the wire bank cutter assembly 60 downwardly while the slug is pushed therethrough. Finally in FIG. 8, the design shown therein is achieved by moving the wire bank cutter assembly 60 up, down, up and back down while the brick slug is pushed therethrough. It is appreciated that many different designs can be achieved by varying the movement of the wire bank cutter assembly 60 as a respective slug is passed therethrough. In addition it is appreciated that the design can be affected and varied by varying the speed or velocity of the wire bank cutter assembly 60 with respect to the speed or velocity of the respective slug being pushed or passed therethrough.

Finally the wire bank cutter assembly 60 can be further actuated to swing back and forth about the axis of shaft 44 which supports the holding structure 40 which in turn holds and supports the wire bank cutter assembly 60. Again this back-and-forth swinging movement can provide further assistance in dislodging and untangling roots, sprigs and other debris that may be caught and held around the respective wires 68. The movement of the holding frame structure 40 can actually be achieved while the brick slug is stationary. It is appreciated that by positioning a brick slug adjacent holding frame structure 40 and stationing the same thereat that the brick slug can be effectively cut by swinging the holding frame structure 40 through the stationary brick slug.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. In a brick handling apparatus having a frame structure and a wire bank cutter assembly including a series of laterally spaced wires extending upwardly through a support surface, the improvment comprising:

a. means for movably mounting said wire bank cutter assembly and the wires thereof for generally linear up and down movement through said support surface;

b. means operatively attached to said wire bank cutter assembly for moving said wire bank cutter assembly upwardly and downwardly within said movable mounting means and through said support surface;and c. slug pusher means for pushing brick slugs through said wire bank cutter assembly as the wire bank cutter assembly is being moved through said support surface.

2. The improved brick handling apparatus of claim 1 wherein said means for movably mounting said wire bank cutter assembly for up and down movement includes a holding frame structure that includes an area for receiving and holding said wire bank cutter assembly and which allows said wire bank cutter assembly to move generally upwardly and downwardly therein in rectilinear fashion.

3. The improved brick handling apparatus of claim 2 further including means for movably mounting said holding frame structure and means for moving said holding frame structure in a back-and-forth fashion.

4. The improved brick handling apparatus of claim 3 wherein said means for movably mounting said holding frame structure includes means for pivotly mounting the same about a transverse axis and wherein said means for moving said holding frame structure is operative to pivot said holding frame structure about said transverse axis resulting in said wire bank cutter assembly held thereby being swung generally back and forth relative to said slug pusher means.

5. The improved brick handling assembly of claim 2 wherein said holding frame structure includes front and rear roller means and wherein said wire bank cutter assembly is confined between said front and rear roller means and movable upwardly and downwardly therein.

6. The improved brick handling apparatus of claim 5 wherein said front and rear roller means includes at least one roller that extends transversely across one side of said wire bank cutter assembly and engages the respective wires of said wire bank cutter assembly as the same moves upwardly and downwardly in said holding frame structure.

7. The improved brick handling apparatus of claim 6 wherein said roller that extends transversely across one side of said wire bank cutter assembly includes a series of laterally spaced notches that align with and receive respective wires of said wire bank cutter assembly as the same moves upwardly and downwardly within said holding frame structure.

8. The improved brick handling apparatus of claim 5 wherein said means for moving said wire bank cutter assembly further includes a torsion bar assembly operatively connected to said wire bank cutter assembly for maintaining the same generally level as the same is moved upwardly and downwardly in said holding frame structure.

9. The improved brick handling apparatus of claim 8 wherein said torsion bar assembly comprises a transverse pivot shaft rotatively journaled above said wire bank cutter assembly, a pair of laterally spaced arms connected to and extending from said pivot shaft, and a connecting link operatively interconnected between each of said arms and said wire bank cutter assembly.

10. The improved brick handling apparatus of claim 9 wherein said means for moving said wire bank cutter assembly includes hydraulic cylinder means operatively connected to said wire bank cutter assembly for moving the same upwardly and downwardly.

11. A brick cutting and handling apparatus having a movable wire bank cutter assembly comprising:

a. a main frame structure;

b. a brick support surface having openings formed therein for supporting brick material being pushed thereover;

c. a wire bank cutter assembly including a series of laterally spaced wires extending generally vertically through the openings within said brick support surface;

d. brick slug pusher means for engaging a brick slug and pushing the same towards and through said wire bank cutter assembly where the respective wires cut the brick slug into a series of bricks;

e. means for movably mounting said wire bank cutter assembly for generally vertical up and down movement with respect to said brick support surface, said means for movably mounting said wire bank cutter assembly including a holding frame structure having a receiving area formed therein for receiving said wire bank cutter assembly and allowing said wire bank cutter assembly to move in a generally linear up and down fashion through said support surface;

f. drive means operatively connected to said wire bank cutter assembly for driving said wire bank cutter assembly linearly upwardly and downwardly within said receiving area of said holding frame structure such that respective wires of said wire bank cutter assembly move generally upwardly and downwardly within the openings provided within said brick support surface; and g. said drive means including means for sensing the effective movement of said pusher means for actuating said drive means in timed relationship to the movement of said brick slug pusher means such that said wire bank cutter assembly and said brick slug pusher means are actuated and moved in unison.

12. The brick cutting and handling apparatus of claim 11 wherein said holding frame structure includes spaced apart roller means that define an area therebetween for receiving said wire bank cutter assembly and wherein said wire bank cutter assembly is movably confined between said roller means.

13. The brick cutting and handling apparatus of claim 12 wherein said brick slug pusher means includes a brick slug pusher and wherein said apparatus further comprises means for moving said frame holding structure back and forth with respect to said brick slug pusher wherein as said frame holding structure is moved back and forth said wire bank cutter assembly confined therein is also constrained to move back and forth therewith.

14. A method of cutting and handling bricks comprising the steps of:

a. movably mounting a wire bank cutter assembly to a brick handling apparatus for generally linear up and down movement through a support surface forming a part of said brick handling apparatus;

b. moving said wire bank cutter assembly in a generally linear up and down fashion through said support surface; and c. pushing a brick slug along said support surface through said wire bank cutter assembly while continuing to move said wire bank cutter assembly through said support surface.

15. The method of cutting brick of claim 14 including the step of forming a swirl-like pattern along opposite sides of the individual bricks engaged and cut by the wires of said wire bank cutter assembly by moving said wire bank cutter assembly generally vertically as a brick slug is being pushed through said wire bank cutter assembly.

16. The method of cutting brick of claim 14 including the step of removing twigs from said brick slugs by moving said wire bank cutter assembly downwardly through said support surface as a respective brick slug is pushed over said support surface and through the wire bank cutter assembly such that said twigs become entangled in the respective wires forming a part of said wire bank cutter assembly and are thereby pulled from said brick slugs as said wire bank cutter assembly moves downwardly through said support surface.

17. The method of cutting brick of claim 16 including the step of removing said twigs from said wire bank cutter assembly by moving said wire bank cutter assembly upwardly through said support surface and the overlying brick slugand stripping said twigs from the respective wires forming a part of said wire bank cutter assembly as the wires are moved upwardly through said support surface and overlying brick slugs.

* * * * *